United States Patent [19]

Connelly

[11] Patent Number: 4,488,551

[45] Date of Patent: Dec. 18, 1984

[54] PACIFIER WITH FLOW REGULATING MEANS

[76] Inventor: Robert W. Connelly, 312 Charing Cross Rd., Elk Grove Village, Ill. 60007

[21] Appl. No.: 399,500

[22] Filed: Jul. 19, 1982

[51] Int. Cl.[3] ..... A61J 7/00; A61J 11/02; A61J 11/04; A61J 17/00

[52] U.S. Cl. ..... 128/360; 215/11 R; 215/11 B

[58] Field of Search ..... 215/11 R, 11 D, 11 B; 128/359, 360; 604/77

[56] References Cited

U.S. PATENT DOCUMENTS

| | | | |
|---|---|---|---|
| 516,561 | 3/1894 | Bosch | 128/359 |
| 745,920 | 12/1903 | Spencer | 128/360 |
| 1,095,264 | 5/1914 | Bridges | 128/360 X |
| 2,612,165 | 9/1952 | Szuderski | 128/360 |
| 2,743,727 | 5/1956 | Griesinger | 128/360 |
| 2,807,384 | 9/1957 | Lipari | 215/11 R |
| 2,836,321 | 5/1958 | Soltesz et al. | 215/11 R |
| 2,889,829 | 6/1959 | Tannenbaum et al. | 128/360 X |
| 2,954,030 | 9/1960 | Jozwiak | 128/360 X |
| 2,987,209 | 6/1961 | Leonard | 215/11 |
| 3,424,157 | 1/1969 | Di Paolo | 128/252 |
| 3,477,603 | 11/1969 | Koll | 215/11 |
| 3,500,831 | 3/1970 | Schaar | 215/11 B |
| 3,610,248 | 10/1971 | Davidson | 128/360 |

*Primary Examiner*—William Price
*Assistant Examiner*—Sue A. Weaver
*Attorney, Agent, or Firm*—Dressler, Goldsmith, Shore, Sutker & Milnamow, Ltd.

[57] ABSTRACT

A pacifier having a fluid-filled chamber removably secured to a nipple by a threaded collar and locking ring assembly includes means for controlling the volume of fluid delivered through the nipple, the means comprising an absorbant material within the nipple which acts as a barrier to restrict the flow of fluid therethrough. The pacifier can also be used without the locking ring whereby the threaded collar is secured to the threaded neck of a nursing bottle.

5 Claims, 3 Drawing Figures

PACIFIER WITH FLOW REGULATING MEANS

BACKGROUND OF THE INVENTION

The present invention relates to an improved device for infant feeding which includes means for controlling the volume of fluid delivered through a nipple. In particular, the controlling means comprises an absorbant material within the nipple which acts as a barrier to restrict the flow of fluid. The device can be used with or without a nursing bottle to control liquid and air intake by an infant.

The prior art includes several references to nipple valve constructions for regulating fluid flow; and in accordance with the provisions of 37 C.F.R. 1.97 et seq., applicant states that the following references constitute the closest prior art of which he is aware.

U.S. Pat. No. 2,987,209 to Leonard discloses a nipple valve constuction that permits fluid flow from a bottle to a nipple in response to external pressure, but which prevents the reverse flow of either liquid or air from the nipple into the bottle.

U.S. Pat. No. 3,424,157 to di Paolo relates to a nursing nipple provided with a bulbous fluid storage chamber and a connecting nipple portion having an outlet aperture for the flow of a fluid therethrough. A partition between the chamber and the nipple portion regulates the fluid flow in response to external pressure.

U.S. Pat. No. 3,477,603 to Koll describes an infant feeding bottle having an integral opening means thereon to prevent contamination of the fluid contained in the bottle. The nipple includes a flange and a plurality of holes at the lower end thereof, the holes allow fluid to flow from the bottle and into the nipple.

None of the above prior art references, however disclose an absorbant material within the nipple which acts as a barrier to restrict the flow of fluid. Moreover, the nursing nipples of the prior art must be used with a bottle and are not suitable for use as a hand-held pacifier without a bottle.

SUMMARY OF THE INVENTION

A pacifier having a fluid-filled chamber removably secured to a nipple by threaded collar and locking ring assembly includes means for controlling the volume of fluid delivered through the nipple, the means comprising an absorbant material within the nipple which acts as a barrier to restrict the flow of fluid. The open ends of the chamber and the nipple include flanges that are held between the threaded collar and the locking ring to sealingly engage the nipple to the chamber.

The device can also be used without the locking ring whereby the threaded collar removably engages the threaded rim portion of a nursing bottle. In this embodiment, the flanges are held between the threaded collar and the rim portion. In either construction, holes are provided in the side of the container near the flange for the passage of liquids and air into and out of the chamber.

DETAILED DESCRIPTION OF THE INVENTION

Figure 1:
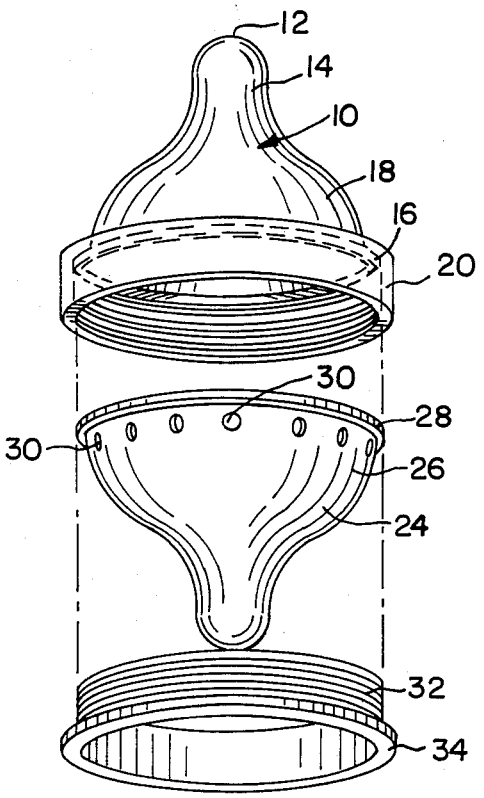
FIG. 1 is an exploded perspective view of a first embodiment of the device.

Referring to FIG. 1, the device comprises a nipple 10 having a narrow opening 12 in an upper end 14 and an outwardly extending annular flange 16 about an open lower end 18. The nipple 10 is positioned within a threaded collar 20 having an inwardly projecting annular shoulder portion 22 so that the flange 16 rests against the shoulder portion 22 (see FIG. 2).

A bulbous chamber or reservoir 24, which in the illustrated embodiment has a shape similar to that of the nipple 10, has an open upper end 26 which includes an outwardly extending annular flange 28 having the same inner and outer diameters as the flange 16. The reservoir 24 can also have a hemi-spherical shape or the like. Adjacent the flange 28 is a plurality of holes 30 in the side of the reservoir 24 near the open upper end 26, which permit air to pass into and out of the device. The function of the holes will be explained with reference to FIG. 2.

Figure 2:
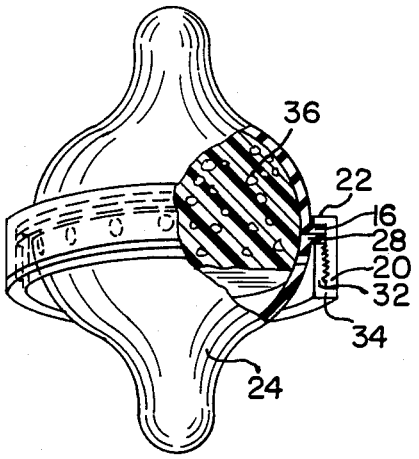
FIG. 2 is a perspective and partial cross-sectional view showing the assembled embodiment of FIG. 1.

In the embodiment of FIGS. 1 and 2, the upper end 26 of the reservoir 24 is positioned within the threaded collar 20 so the flange 28 engages the flange 16 of the nipple. A locking ring 32 having threads on its outer surface which correspond to the threads of the collar 20, can be rotated within the threaded collar 20 to secure the flange 28 against the flange 16. The locking ring 32 includes a lip portion 34 which functions as a gripping means as the locking ring is rotated and which presses against the lower portion of the collar 20 when the device is assembled.

The nipple 10 contains an absorbant material 36 that conforms to the shape of the nipple and acts as a barrier to restrict the flow of fluid therethrough. The flow rate depends, of course, on the size and cross-sectional area of the absorbant material used and the nature of that material. Absorbant materials suitable for use in the present invention comprise non-toxic porous substances including any open-celled vinyl composition. The absorbant material is preferably manufactured as a single use, disposable item.

As shown in the cutaway section of FIG. 2, the absorbant material 36 fills the nipple 10 and extends below the flange 16 of the nipple so that when the device is assembled, the absorbant material covers the inside surface of the reservoir 24 about the holes 30. As a result, liquid within the reservoir does not pass through the holes 30 when the device is inverted, but during use air can pass through the holes 30 and the absorbant material 36 to equalize pressure between the inside of the device and the atmosphere.

Figure 3:
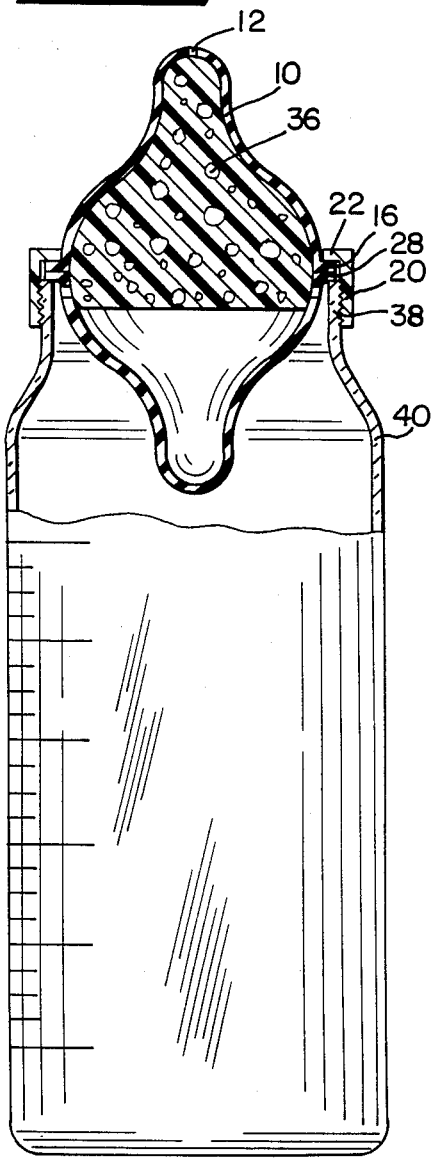
FIG. 3 is a cross-sectional view of a second embodiment of the device secured to a nursing bottle.

Turning now to FIG. 3, the device is shown removably secured to the threaded neck 38 of a bottle 40. Specifically, the nipple 10 containing the absorbant material 36 is positioned within the threaded collar 20 so that the flange 16 rests against the shoulder portion 22. The reservoir 24 is placed within the neck 38 so the flange 28 can support the reservoir within the upper end of the bottle 40, and the reservoir is filled with fluid. The collar 20 is then rotated onto the neck 38 of the bottle and the flanges 16 and 28 of the nipple 10 and reservoir 24, respectively, are compressed together to form a liquid-tight seal.

When the bottle is inverted, liquid can flow through the holes 30 of the reservoir 24 and into the absorbant material 36. At the same time, air can pass in the reverse direction through the absorbant material and into the bottle.

The present invention constitutes a significant improvement in the design and application of pacifiers and nursing bottles. Use of the device presents no sanitation problems since the absorbant material is discarded after each feeding.

Furthermore, it will be understood that various changes and modifications can be made in the above-described invention without departing from the spirit thereof, particularly as defined in the following claims.

That which is claimed is:

1. A resealable fluid-containing pacifier for regulating the fluid intake of an imfant comprising:

(a) a chamber portion closed at a lower end and open at an upper end, said chamber portion including an outwardly extending flange and a plurality of openings at the upper end thereof;

(b) a nipple having a flange about the lower end thereof adapted to sealingly engage the flange of said chamber portion, said nipple containing an absorbant material for regulating the flow of fluid through the nipple;

(c) a collar member for engaging the flange about the lower end of said nipple; and (d) locking means which removably engages the collar member to sealingly engage the flange of the chamber portion with the flange of the nipple.

2. The pacifier according to claim 1 wherein the absorbent material conforms to the cross-sectional shape of the nipple.

3. The pacifier according to claim 1 wherein the absorbent material fills the nipple and at least the upper end of said chamber portion.

4. The pacifier according to claim 1 wherein the absorbent material is formed of an open-celled vinyl composition.

5. The pacifier according to claim 1 wherein the locking means threadably engages the collar member to sealingly engage the flange of the chamber portion to the flange of the nipple.

* * * * *